US007611816B2

(12) United States Patent
Tuji et al.

(10) Patent No.: US 7,611,816 B2
(45) Date of Patent: Nov. 3, 2009

(54) PROCESS FOR PRODUCING TONER PARTICLES

(75) Inventors: Yoshinori Tuji, Shizuoka-ken (JP); Hidekazu Fumita, Susono (JP); Minoru Omura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 418 days.

(21) Appl. No.: 11/459,613

(22) Filed: Jul. 24, 2006

(65) Prior Publication Data

US 2008/0241730 A1 Oct. 2, 2008

(30) Foreign Application Priority Data

Jul. 29, 2005 (JP) ..... 2005-220272
Jul. 29, 2005 (JP) ..... 2005-220277

(51) Int. Cl.
*G03G 9/12* (2006.01)

(52) U.S. Cl. ..... 430/137.1; 430/137.15; 430/137.16

(58) Field of Classification Search ..... 430/137.1, 430/137.15, 137.16
See application file for complete search history.

(56) References Cited

U.S. PATENT DOCUMENTS

| | | | | |
|---|---|---|---|---|
| 3,988,235 | A | 10/1976 | Shibata | |
| 4,070,293 | A * | 1/1978 | Fogarty, Jr. | 210/401 |
| 4,350,597 | A * | 9/1982 | Selm et al. | 588/315 |
| 4,477,358 | A * | 10/1984 | Heintges et al. | 210/783 |
| 6,309,788 | B1 | 10/2001 | Tsuji | |
| 6,358,406 | B1 * | 3/2002 | Hirs | 210/90 |
| 6,495,303 | B1 | 12/2002 | Kanda | |
| 6,627,374 | B2 | 9/2003 | Fumita | |
| 6,835,521 | B2 | 12/2004 | Tsuji | |
| 6,953,648 | B2 | 10/2005 | Tsujino | |
| 7,223,510 | B2 | 5/2007 | Matsui | |
| 2002/0009661 | A1 * | 1/2002 | Hashimoto et al. | 430/106.1 |
| 2002/0042014 | A1 * | 4/2002 | Fujino et al. | 430/137.17 |
| 2004/0110081 | A1 * | 6/2004 | Tanaka et al. | 430/137.15 |
| 2004/0152006 | A1 * | 8/2004 | Teshima | 430/109.4 |
| 2008/0190418 | A1 * | 8/2008 | Miller et al. | 128/200.23 |

FOREIGN PATENT DOCUMENTS

| | | |
|---|---|---|
| JP | 51014895 | 2/1976 |
| JP | 5265252 | 10/1993 |
| JP | 2002214836 | 7/2002 |
| JP | 2002365839 | 12/2002 |
| JP | 2004302099 | 10/2004 |
| JP | 2005010723 | 1/2005 |

* cited by examiner

*Primary Examiner*—Hoa V Le
(74) *Attorney, Agent, or Firm*—Fitzpatrick, Cella, Harper & Scinto

(57) ABSTRACT

In a process for producing toner particles through granulation by a wet process, a process for producing toner particles is provided that enables reduction of water content in wet toner particle cakes obtained by separating toner particles from a toner particle dispersion in a good efficiency, followed by washing, and enables efficient wash-away of impurities remaining on the toner particle surfaces so as to promise superior image characteristics. The toner particles are produced through a filtering step in which a slurry which contains toner particles is subjected to solid-liquid separation by means of a belt filter having a pressing aeration means which carries out aeration with pressing, to form wet toner particle cakes.

23 Claims, 3 Drawing Sheets

PROCESS FOR PRODUCING TONER PARTICLES

BACKGROUND OF THE INVENTION

1. Field of the Invention

This invention relates to a process for producing toner particles which constitute a toner for rendering electrostatic latent images visible in image forming processes such as electrophotography, electrostatic recording, magnetic recording and toner jet recording.

2. Description of the Related Art

Conventionally, electrophotography is a process in which fixed images are obtained by forming an electrostatic latent image on a photosensitive member by various means, developing the latent image by the use of a toner to form a toner image, transferring the toner image to a transfer material such as paper as occasion calls, and then fixing the toner image thereto by the action of heat, pressure, heat-and-pressure, or solvent vapor.

In recent years, toners are roughly grouped into a pulverization toner and a toner obtained through granulation by a wet process. The pulverization toner is produced by melt-kneading a colorant into a thermoplastic resin to make the former dispersed uniformly in the latter, thereafter cooling the resultant melt-kneaded product to solidify, finely pulverizing the kneaded product by means of a fine grinding mill, and classifying the resultant finely pulverized product by means of a classifier to obtain toner particles with the desired particle diameter.

Meanwhile, the toner obtained through granulation by a wet process attracts notice because the toner can have small particle diameter, can have sharp particle size distribution, and also is advantageous for incorporating a release agent in a large quantity. As specific processes for producing toners through granulation by a wet process, proposed are processes for producing toners by a suspension polymerization process, an emulsion polymerization process and other various polymerization processes such as a dissolution suspension process making use of, e.g., a polyester or the like obtained separately by polycondensation.

For example, in the suspension polymerization process and the dissolution suspension process, toner particles having the desired particle diameter are formed in a liquid dispersion medium to obtain a toner particle dispersion. Thereafter, the toner particles are separated from the toner particle dispersion by the use of a separation means as typified by a solid-liquid separator such as a filtering equipment, followed by washing to remove impurities. The wet toner particle cakes thus obtained are dried and then optionally classified, and thereafter an additive(s) is/are optionally added to produce a toner (see, e.g., Japanese Patent Application Laid-open No. S51-14895).

In the emulsion polymerization process, first, a monomer composition containing a polymerizable monomer(s), a polymerization initiator and a surface-active agent, and optionally a cross-linking agent, a chain transfer agent and other additives is dispersed in an aqueous medium by the use of a suitable stirrer to carry out polymerization reaction to obtain emulsified resin particles having the desired particle diameter. Thereafter, a colorant is uniformly finely dispersed in an aqueous medium containing a surface-active agent, to make it associate (i.e., agglomerate and fuse) with the emulsified resin particles to obtain a toner particle dispersion having the desired particle diameter. After that, filtration, washing, drying and classification are carried out like those in the suspension polymerization process and the dissolution suspension process (see, e.g., Japanese Patent Application Laid-open No. H05-265252).

The toner particles obtained through granulation by such a wet process are formed in the liquid dispersion medium, and hence their particle surfaces tend to be affected by various components standing dispersed or dissolved in the liquid dispersion medium. For example, in the suspension polymerization, an aqueous medium containing a dispersion stabilizer of various types is commonly used, and this dispersion stabilizer adheres to the surfaces of the toner particles formed.

In the toner formed by the suspension polymerization process, in order to improve its chargeability, a positively charging or negatively charging, charge control agent is incorporated in the polymerizable monomer composition to carry out the polymerization. However, a charge control agent with a high polarity may partly dissolve in the aqueous dispersion medium to adhere to the surfaces of the toner particles formed. Unless various components having adhered to such toner particle surfaces are sufficiently and uniformly washed and removed in the step of filtration and washing after the polymerization, the toner may have a broad charge quantity distribution to tend to cause a decrease in image density and cause fog, especially under conditions of high temperature and high humidity.

Further, where the toner particles are formed by an emulsification agglomeration process, a surface-active agent must be used as an emulsifying agent in a large quantity. If this surface-active agent remains in a large quantity on the surfaces of the toner particles formed, the toner tends to cause the decrease in image density and the fog more remarkably than the toner produced by the suspension polymerization process.

Accordingly, in the process for producing toner particles through granulation by a wet process (hereinafter often "wet-process granulation process), methods for washing the toner particles having been formed are proposed in variety.

For example, a method is proposed in which, using as a filtering washer a belt fitter having a filter cloth and a vacuum tray which are kept in close contact with each other, toner particles are separated from a toner particle dispersion and then washed (see e.g., Japanese Patent Application Laid-open No. 2002-365839). According to this method, the toner particles can be separated from the toner particle dispersion in a good efficiency and then washed to obtain a toner having superior image characteristics.

This method can be said to be a superior separation and washing method. However, in recent years, as user's needs have become diversified, electrophotographic images are demanded to be highly minute images like photographic images. Under such circumstances, there has still been room for improvement.

As one of effective means for obtaining highly minute images in electrophotographic images, it is to make developer toner particles have small particle diameter. Making the toner particles have such small particle diameter by the pulverization process is not preferable because a great energy is required for pulverization. On the other hand, in the wet-process granulation process, it is easy to make toner particles have small particle diameter. However, in making toner particles have small particle diameter, the water may poorly be drawn off (poor water draw-off) when the toner particles are separated from the toner particle dispersion, tending to make the resultant wet toner particles cakes have a high water content. This is considered due to an increase in particle surface area per unit volume of the cakes formed of wet toner particles. This poor water draw-off leads to insufficient wash-away of the above various components having adhered to the toner particle surfaces.

As a method for avoiding such poor water draw-off, a filtering and washing method that utilizes the dilatancy effect is proposed (see, e.g., Japanese Patent Application Laid-open No. 2004-302099). It is described that, in this method, impact and vibration bring the dilatancy effect, which liquefies cakes to achieve a low water content. However, as a result of studies made by the present applicant, this method has been found to be unable to achieve a sufficiently low water content.

The slurry formed upon completion of the polymerization reaction tends to cause bubbles in a large quantity as a result of stirring and so forth. Accordingly, it is studied that the bubbles of the particle-containing slurry are kept decreased before the particles are filtered and washed. If a slurry containing such bubbles is fed to the step of filtration, a problem may arise such that non-uniform cakes are formed to cause faulty dehydration and faulty washing. Where a continuous belt filter, a siphon pillar type centrifuge, a decanter type centrifugal separator or the like is used, it has also been a problem that its use brings about a very low rate or speed at which cakes are formed and washing water is removed.

As a means for keeping bubbles from forming, it is proposed to control stirring conditions (see, e.g., Japanese Patent Application Laid-open No. 2002-214836). From the viewpoint of making gases less mixed up in liquids, this method is effective in keeping bubbles from forming. However, where, e.g., an acid and an alkali are added to the slurry, the acid and alkali added may react with substances dissolved in the liquid phase, to produce gases. As to such bubbles having formed in the interior of the slurry as a result of such chemical reaction, it has been difficult to keep them from forming, if the stirring conditions are merely controlled.

Thus, it has been sought to provide a production process by which bubbles can be kept from forming and can be removed and a slurry little containing bubbles can be fed to the step of filtration and washing; the bubbles being firstly those caused by foaming depending on production process conditions and by foaming due to chemical reaction, and besides those caused by every situation.

Not intended for defoaming, it is also proposed to use a defoaming machine for the purposes of shape control and desolvation (see, e.g., Japanese Patent Application Laid-open No. 2005-10723).

SUMMARY OF THE INVENTION

An object of the present invention is to provide a process for producing toner particles that has solved the above problems.

That is, an object of the present invention is to provide, in a process for producing toner particles through granulation by a wet process, a process for producing toner particles that enables reduction of water content in wet toner particle cakes obtained by separating toner particles from a toner particle dispersion in a good efficiency, followed by washing.

Another object of the present invention is to provide a process for producing toner particles by separating toner particles from a toner particle dispersion in a good efficiency, followed by washing, which toner particles promise superior image characteristics.

As a result of extensive studies, the present inventors have discovered that cakes composed of toner particles, formed on a belt filter, may be aerated with a suitable compressed gas while maintaining good formation of the cakes, and this enables reduction of water content in the wet toner particle cakes to be obtained. Thus, they have accomplished the present invention.

They have further discovered that the reduction of water content in the wet toner particle cakes enables uniform wash-away of various components having adhered to the toner particle surfaces, and the toner obtained promises formation of images having superior image characteristics. Thus, they have accomplished the present invention.

That is, the present invention is a process for producing toner particles in a liquid dispersion medium; the process being a toner particle production process having at least a filtering step in which a slurry which contains toner particles is subjected to solid-liquid separation by means of a belt filter having a pressing aeration means which carries out aeration with pressing, to form wet toner particle cakes.

Further features of the present invention will become apparent from the following description of exemplary embodiments (with reference to the attached drawings).

DESCRIPTION OF THE PREFERRED EMBODIMENTS

The present invention is described below in detail.

Figure 1:
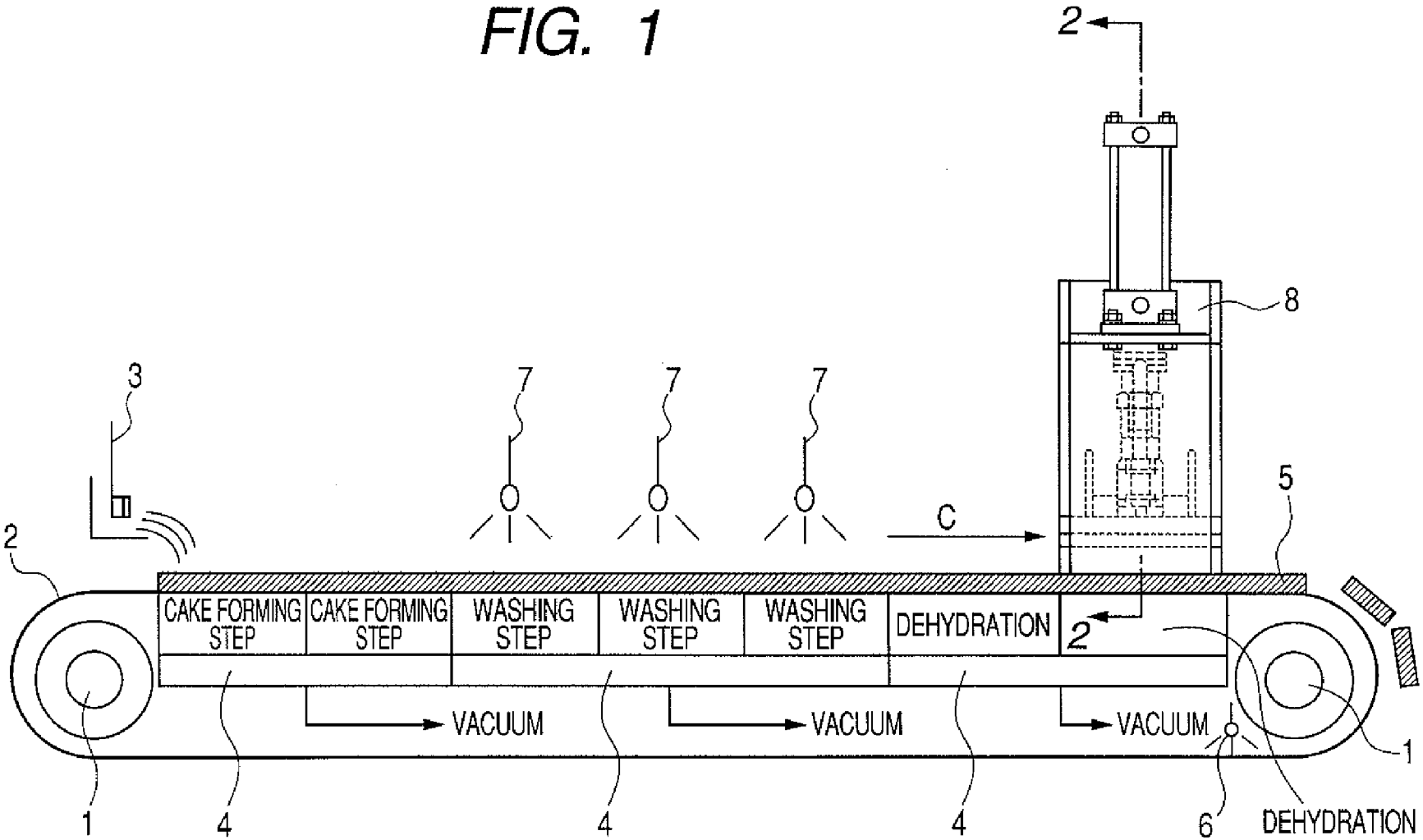
FIG. 1 is a schematic view of a belt filter provided with a pressing aeration mechanism having a pressing aeration means.
Figure 2:
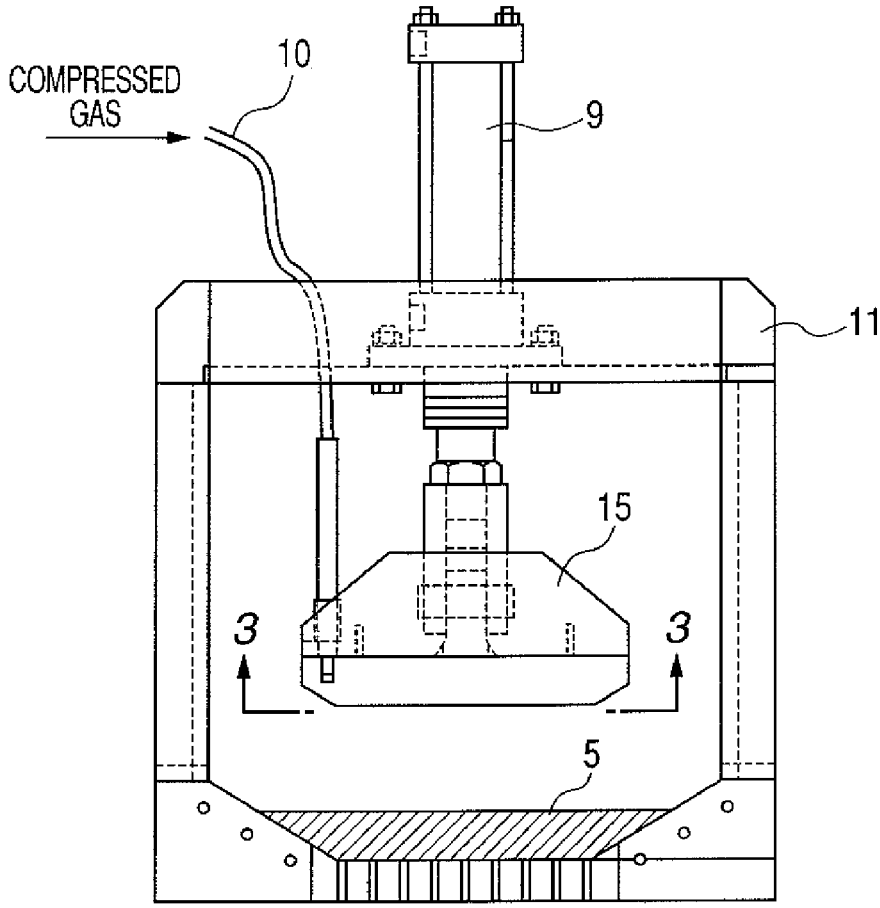
FIG. 2 is a sectional view along the line 2-2 in FIG. 1.
Figure 3:
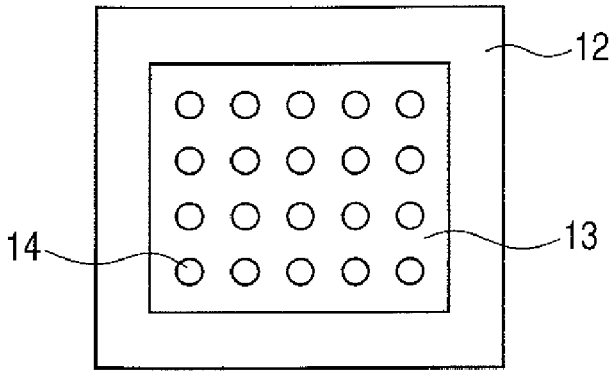
FIG. 3 is a sectional view along the line 3-3 in FIG. 2.

FIGS. 1 to 3 show a preferred example of a belt filter usable in the present invention, which, however, is by no means limited to this example.

In FIGS. 1 and 2, reference numeral 1 denotes rolls; 2, a filter cloth; 3, a liquid feed vent; 4, vacuum trays; 5, cakes; 6, a filter cloth washer; 7, cake washers; and 8, a pressing aeration mechanism.

FIG. 2 is a sectional view along the line 2-2 in FIG. 1, and is a schematic view of the pressing aeration mechanism 8 as a preferred example. In FIG. 2, reference numeral 9 denotes a contact and separation mechanism; 10, a compressed-gas inlet; 11, a casing; and 15, a pressing aeration means.

FIG. 3 is a sectional view along the line 3-3 in FIG. 2, and is a partial enlarged view of the pressing aeration means 15 at its part which is to come into contact with the cakes 5. In FIG. 3, reference numeral 12 denotes an elastic member; 13, a perforated member; and 14, compressed-gas outlets.

An embodiment of the process for producing toner particles according to the present invention is described below with reference to FIGS. 1 to 3.

The belt filter shown in FIG. 1 has the filter cloth 2, which is stretched over the rolls 1, and is continuously or intermittently driven in the direction of an arrow C with the rotation of the rolls 1. Beneath the upper side at drive of the filter cloth 2, a stationary vacuum tray 4 provided solely or divided in plurality is placed. This vacuum tray 4 is so structured that they can be evacuated by means of a vacuum pump (not shown).

A dispersion stabilizer of various types is present on the surfaces of toner particles contained in the toner particle dispersion obtained by the wet-process granulation process of various types. In order to dissolve or remove this dispersion stabilizer, pretreatment is carried out which is suited for each wet-process granulation process. After this pretreatment has been carried out, the toner particle dispersion is fed onto the filter cloth 2, and is filtered and provisionally dehydrated under the influence of evacuation (a cake forming step; in two stages in what is shown in FIG. 1).

In the case of the wet-process granulation process carried out by suspension polymerization, acid treatment is carried out in order to dissolve a dispersing agent present on the toner particle surfaces. In this occasion, the foaming tends to take place. This phenomenon of foaming adversely affects filtration and dehydration effects in the cake forming step, and has a possibility of lowering efficiency. Accordingly, when the acid treatment is carried out, it is preferable to select an equipment and a method which keep the foaming from taking place, or to carry out defoaming treatment. With regard to the defoaming treatment, it will be described later.

Meanwhile, filtrates having come from the filtration in each stage of the cake forming step are collected in the vacuum tray 4, and are sent to a vacuum tank (not shown) through a filtrate pipe (not shown). Here, in order to make the evacuation action exerted effectively, it is preferable for the filter cloth 2 to be intermittently driven, and, in the state of being evacuated, it is preferable for the filter cloth 2 to come into close contact with, and not to rub against, the vacuum tray 4. If the filter cloth 2 is continuously driven, a difficulty may come about in the close contact between the filter cloth 2 and the vacuum tray 4 to make it difficult to attain a high degree of vacuum. If such a high degree of vacuum is not attained, insufficient filtration and provisional-dehydration effects may result to make it difficult to effectively separate the toner particles from the liquid dispersion medium.

Next, the cakes 5 having been filtered and provisionally dehydrated and the filter cloth 2 are forwarded in the direction of the arrow C with the rotation of the rolls, and sent to a washing step having at its/their upper part a single, or a plurality of, cake washer(s) 7 (the washing step is in three stages in what is shown in FIG. 1). Optionally one kind or some kinds of washing fluid(s) is/are sprayed from the cake washer(s) 7, whereby dissolved substances or dispersed substances in the cakes 5 are washed and removed. Then, these substances are discharged together with the filtrates collected in the vacuum tray 4. Here as well, it is preferable for the filter cloth 2 to come into close contact with, and not to rub against, the vacuum tray 4 in order to attain a high degree of vacuum as stated above.

Next, the cakes 5 having been washed and the filter cloth 2 are forwarded in the direction of the arrow C with the rotation of the rolls, and sent to a dehydrating step. It is preferable for the dehydrating step to be, as shown in FIG. 1, divided into a plurality of stages (a case in which the dehydrating step is in two stages is shown in FIG. 1), and it is preferable that the pressing aeration mechanism 8 having the pressing aeration means 15 is provided in at least one stage, the stage lying on the downstream side with respect to the direction of the arrow C. Inasmuch as the pressing aeration mechanism 8 is provided on the most downstream side as shown in FIG. 1, any water having not completely been pressed out can further be pressed out in the final stage, thus the action of dehydration can effectively be exerted.

The pressing aeration mechanism 8 has the contact and separation mechanism 9, and is so structured that the pressing aeration means 15, which has a perforated portion 13 with holes and has an elastic portion 12 being so provided as to surround the perforated portion 13 and having elasticity, can come into contact with and separate from the cakes 15. The perforated portion 13 is, as shown in FIG. 3, so constituted as to have a plurality of holes (compressed-gas outlets 14) made through, e.g., a suitable iron plate by punching.

The contact and separation mechanism 9 is operated, where the perforated portion 13 comes into contact with the cakes 5 to press the same. Further, in the state of contact, the compressed gas is spurted from the compressed-gas outlets 14 to make the compressed gas pass through the cakes 5. Here, the elastic portion 12 is also brought into contact with the cakes 15 so that the compressed gas can concentratedly act on the cakes. Pressing aeration is thus carried out to reduce the water content in the cakes. Together with the water content, various components having adhered to the toner particle surfaces are also separated from toner particles, thus uniform washing can be effected. There are no particular limitations on the number of the holes (compressed-gas outlets 14). The total area of holes that is formed by a plurality of holes may hold 20 to 70% with respect to the surface area of the iron plate before punching. This is preferable in view of the strength of the pressing aeration mechanism and in order to attain a suitable level of aeration.

Here, if, e.g., the compressed-gas outlets 14 provided in the perforated portion 13 may clog depending on how the cakes 5 stand, they may be covered with a filter, a mesh or the like to prevent them from clogging.

There are no particular limitations on the contact and separation mechanism 9 as long as it enables motion of contact with and separation from the cakes 15. It may preferably a hydraulic mechanism. Inasmuch as it is a hydraulic mechanism, the pressure at which the elastic portion 12 and the perforated portion 13 come into contact with the cakes 5 can readily be adjusted, and this is effective also in controlling the motion of contact with and separation from the cakes.

At the time of pressing, the elastic portion 12 may preferably be kept in contact with the filter cloth 2 (actually, in contact through the toner cakes) at pressure P2 (kPa), where the pressure may preferably be:

$$20 \leqq P2 \leqq 1{,}000.$$

This pressure P2 acts as sealing pressure for preventing the compressed gas from leaking and passing over the outside of the cakes when the cakes 5 are aerated with the compressed gas. Hence, if it is less than 20 kPa, an insufficient sealing pressure may come when the compressed gas is passed through the compressed-gas outlets 14, making it unable to maintain the cakes in a good state. If the cakes are not maintained in a good state, the cakes 5 may scatter as if they explode, or may come cracked, and hence the various components having adhered to the toner particle surfaces may come no longer separable from the toner particles. A pressure of more than 1,000 kPa is also undesirable because there is a possibility of making the toner particles in the cakes 5 deformed to affect them adversely.

The elastic portion 12 is so provided as to surround the perforated portion 13, and may preferably be so provided as to have width D (mm; contact width) around the perforated portion 13 in the following range of:

$$30 \leqq D \leqq 300.$$

If the contact width is less than 30 mm, it is difficult to obtain the desired sealing effect when the cakes are aerated through the perforated portion 13, so that the compressed gas may leak through the elastic portion 12 to make it difficult to well reduce the water content of the wet toner particle cakes. In particular, it is difficult to seal the pressing aeration means 15 on the downstream side of the filter cloth 2 with respect to the direction of its movement because the water content of wet toner particle cakes coming into contact with the elastic portion 12 at that part has been reduced. However, where the sealing is effected in the above contact width, good sealing can be effected. If the contact width is more than 300 mm, it may come difficult to secure the area of the perforated portion 13 sufficiently. Also, in order to secure the area of the perforated portion 13 sufficiently, the apparatus must be made large, undesirably.

As a member constituting the above elastic portion 12, there are no particular limitations thereon as long as it is a member which enables the above sealing to be sufficiently effected. It may preferably be a soft rubber, and may preferably be a member having rubber hardness F (degree) of:

$$10 \leqq F \leqq 40.$$

Stated specifically, chloroprene rubber and EPDM (ethylene-propylene diene rubber) which have the above hardness are preferred. The chloroprene rubber is particularly preferred.

If the member has a rubber hardness of less than 10 degrees, its durability tends to deteriorate. If it has a rubber hardness of more than 40 degrees, no good sealing may be effected to bring about a possibility that the compressed gas leaks.

The rubber hardness is measured with Asker rubber hardness meter (Model C; standardized according to JIS K 7312), in which an indenter point having a definite shape is pressed against the surface of a sample by the force of a spring to deform the sample, and its hardness is measured on the basis of "the depth of indentation to the sample" at the position where the resisting force of the sample balances with the force of the spring.

The compressed gas may preferably be compressed air in view of cost. The compressed air may preferably have pressure P1 (kPa) of:

$$10 \leqq P1 \leqq 900.$$

If the compressed air has a pressure of less than 10 kPa, the aeration may insufficiently be effected to make it difficult to achieve the desired reduction of the water content. If it has a pressure of more than 900 kPa, the cakes 5 tend to scatter as if they explode. This makes it difficult to maintain the cakes in a good state and, in addition thereto, requires a high cost for producing the compressed air.

The perforated portion 13 may preferably afford aeration rate G per unit area and unit time ($m^3/m^2 \cdot s$) of:

$$0.01 \leqq G \leqq 0.5.$$

If it affords an aeration rate of less than 0.01 $m^3/m^2 \cdot s$, it is difficult to achieve the desired reduction of water content. If on the other hand it affords an aeration rate of more than 0.5 $m^3/m^2 \cdot s$, the vacuum pump on the downstream side must be made to have a large capacity, resulting in a high cost.

At the time of this pressing aeration as well, it is preferable for the filter cloth 2 to be intermittently driven as stated previously. At the time the filter cloth 2 is stopped during its intermittent movement, the contact and separation mechanism may interlockingly be driven to make the elastic portion 12 and perforated portion 13 come into contact with the cakes 5. This can well exert the sealing action of the elastic portion 12 between it and the cakes 5, and hence enables easy aeration by compressed gas. At the time of the aeration by compressed gas as well, it is preferable to beforehand form the state of vacuum from the vacuum tray 4. Hence, it is preferable for the filter cloth 2 to be so set up as to come into close contact with, and not to rub against, the vacuum tray 4. As long as the vacuum is beforehand formed from the vacuum tray 4 at a high degree, the cakes 5 on the filter cloth 2 can be maintained in a good cake condition at the time of the pressing aeration.

The cakes 5 having been dehydrated are released from the filter cloth 2 in virtue of the curvature brought by the roll 1.

The wet toner particle cakes thus obtained may preferably have a water content of 30% or less, and more preferably 25% or less. If the cakes have a water content of more than 30%, they may bring about a difficulty in their transportation to a post-step, drying step, or cause a lowering of efficiency in the drying step, undesirably. This lowering of drying efficiency may come to trigger heat deterioration of the toner particles, and hence is undesirable also in view of toner quality.

The drying step may preferably be the step of airborne drying in which the wet toner particle cakes are dispersed in hot-air streams and in the form of powder particles so as to be dried while being sent in flows parallel with the hot-air streams. The airborne drying enables the wet toner particle cakes to be dried in a short time and in a large quantity, and can enjoy a much lower cost.

As the matter to be filtered that is to be fed to the above belt filter, it is preferable to use a slurry containing the toner particles having been subjected to defoaming treatment in a defoaming step. In as much as the toner particles are beforehand subjected to the defoaming treatment, the water content of the cakes containing the toner particles can be reduced in a good efficiency.

As methods for defoaming, any of defoaming systems may be used, such as I) pressure defoaming, II) vacuum (reduced pressure) defoaming, III) centrifugal defoaming, IV) defoaming making use of ultrasonic waves, V) defoaming by a cyclone system, and combination of any of I to IV. In particular, defoaming carried out under reduced pressure is preferred from the viewpoint of defoaming efficiency.

An apparatus for the defoaming carried out under reduced pressure or in a vacuum may include, but is not particularly limited to, DP Series (manufactured by $M_{TECHNIQUE}$ Co., Ltd.), Bubble Buster (manufactured by Asizawa Finetech Ltd.), DEAMILD (manufactured by Pacific Machinery & Engineering Co., Ltd.), VISCO DEAERATOR (manufactured by Turbo Kogyo Co., Ltd.).

In regard to the defoaming carried out under reduced pressure or in a vacuum, it is preferable to use an apparatus which carries out the defoaming treatment while forming thin layers.

A defoamer used preferably in the present invention is described below with reference to FIGS. 4 and 5.

Figure 4:
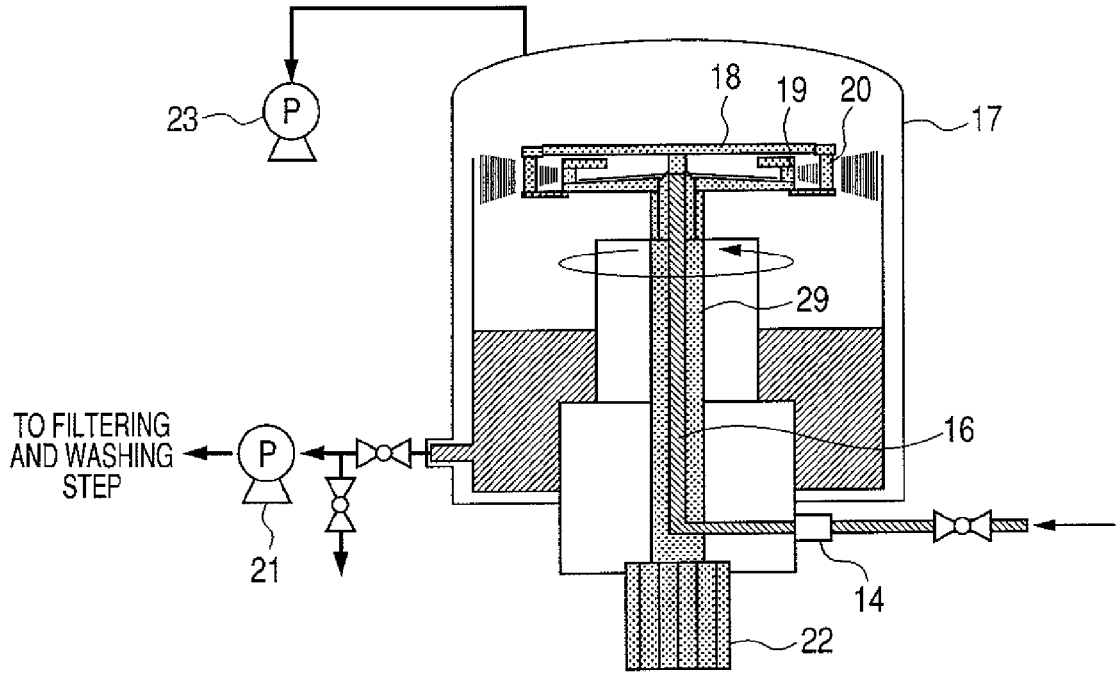
FIG. 4 is a schematic sectional view of a vacuum defoamer of a type that a slurry is sprayed from a rotary disk.

FIG. 4 is a sectional view of a vacuum defoamer of a type that a slurry is sprayed from a rotary disk.

Figure 5:
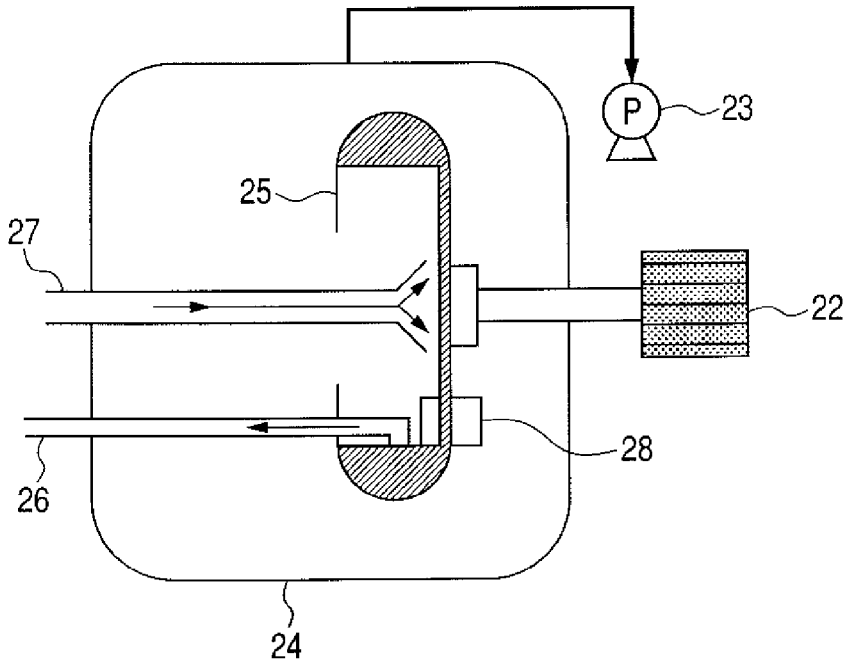
FIG. 5 is a schematic sectional view of a vacuum defoamer of a type that a slurry is so fed to a rotary container as to spread in thin layers.

FIG. 5 is a sectional view of a vacuum defoamer of a type that a slurry is so fed to a rotary container as to spread in thin layers.

In the defoamer shown in FIG. 4, the interior of a vessel 17 is brought into a vacuum by means of a vacuum pump 23, whereby the slurry is sucked up through a suction vent 14 at the lower part of the machine. Next, the slurry is passed through an inflow path 16 provided through the interior of a shaft 29 rotating at a high speed, whereby a liquid phase is centrifuged to the inner-wall side of the shaft 29, and bubbles to the center side of the shaft. Here, the bubbles are drawn into the vessel 17 kept under reduced pressure, to come inflated, so that the slurry is deaerated.

The slurry having been passed through the interior of the shaft 29 is sent to the central inlet of a rotary disk 18 and spreads in thin layers by the action of centrifugal force, whereby the defoaming proceeds. Here, the peripheral speed of the rotary disk at its outer edge may preferably be in the range of from 2 to 30 m/s. If the peripheral speed of the rotary disk at its outer edge is less than 2 m/s, no sufficient centrifugal effect and thin-layer effect may be obtained to damage defoaming performance. If on the other hand the peripheral speed of the rotary disk at its outer edge is more than 30 m/s, a large shear force may be applied to bring about a possibility that the toner particles are damaged.

The slurry sent outward by the action of centrifugal force is further passed through a punched plate 19 and then a filter 20, so that it is sprayed against the wall surface of the vessel 17 in the state it has been finely atomized, and then made into thin-layer flows along the wall surface, whereby minute bubbles are also efficiently removed.

The slurry thus having gone through the defoaming action at several stages is collected at the lower part of the vessel 17, then continuously discharged by means of a discharge pump 21, and thereafter transported to the belt filter according to the present invention.

In the defoamer shown in FIG. 5, the interior of a vessel 24 is brought into a vacuum by means of a vacuum pump 23, whereby the slurry is sucked through a slurry suction vent 27, thus the slurry is fed to the middle portion of a rotary container 25 rotating at a high speed. The slurry thus fed spreads in thin layers along the inner wall surface of the rotary container 25 by the action of strong centrifugal force, and is efficiently defoamed. Here, the bubbles in the slurry are dispersed by the action of strong shear stress, whereby the defoaming proceeds in a good efficiency.

Thereafter, the slurry having been defoamed through the above action is collected at the inner periphery of the rotary container 25 by the action of centrifugal force, and then, by the action of centrifugal force higher than the evacuation, discharged forcedly to the exterior of the apparatus through a slurry discharge vent 26.

Where the toner particles are non-magnetic toner particles, the slurry may preferably, be so defoamed that the toner-particle-containing slurry after defoaming treatment may preferably have a bulk density (kg/l) of 0.75 or less, and more preferably 0.85 or less. Where the toner particles are magnetic toner particles, the slurry may preferably be so defoamed that the toner-particle-containing slurry after defoaming treatment may preferably have a bulk density (kg/l) of 0.86 or more, and more preferably 0.98 or more. The defoaming carried out to give the bulk density within such ranges enables the toner particles to be well washed and filtered in the subsequent steps of dehydration, washing and filtration, and enables improvement in production efficiency.

The slurry may also preferably be so defoamed as to give its bulk density within the range of:

$$1.05 \leqq A/C \leqq 3.00$$

where the bulk density of the toner-particle-containing slurry before defoaming treatment is represented by C (kg/l) and the bulk density of the toner-particle-containing slurry after defoaming treatment by A (kg/l).

The value of A/C may more preferably be within the range of:

$$1.30 \leqq A/C \leqq 2.50.$$

In the case when the above relationship is satisfied, good defoaming is considered achievable without regard to whether the toner particles are magnetic or non-magnetic.

If the value of A/C is less than 1.05, the bubbles may be reduced at so small a degree as to make it difficult to obtain sufficient effects in respect of the washing performance and efficiency in the subsequent filtering and washing step. If on the other hand the value of A/C is more than 3.00, there is a possibility that the toner particle surfaces are damaged because of an impact due to an abrupt shrinkage of slurry volume.

The bulk density (kg/l) is determined by introducing the slurry into a 1 liter measuring cylinder and measuring its mass.

Where the slurry is defoamed under reduced pressure or in a vacuum, the degree of vacuum may preferably be within the range of from 5 to 50 kPa. In particular, where the slurry is continuously discharged from the defoamer by means of a pump, if the degree of vacuum is less than 5 kPa, there are possibilities that the load to the pump increases, the rate constancy of the pump becomes unstable, and the slurry flows backward or comes again foamed because of the suction of air from the discharge vent after pumping. If on the other hand the degree of vacuum is more than 50 kPa, a lowering of defoaming performance may result.

In the toner-particle-containing slurry before defoaming treatment, the toner particles may further preferably be in a concentration within the range of from 10 to 45% by mass. If the toner particles therein is in a concentration of more than 45% by mass, the toner particles may come accumulated in the defoamer not only to cause a decrease in yield, but also to obstruct the flow of the slurry to lower the action of defoaming. In particular, where the slurry is defoamed while its thin layers are formed, such difficulties are especially remarkable. If on the other hand the toner particles therein is in a concentration of less than 10% by mass, the slurry has a low viscosity and a high flowability, and hence there is a possibility that the slurry comes again foamed unless the slurry after defoaming treatment is handled with care.

The process for producing toner particles according to the present invention may preferably be used not only in a process for producing non-magnetic toner particles, but also in a process for producing magnetic toner particles.

As a magnetic material used when the magnetic toner particles are produced by suspension polymerization, it is preferable for the magnetic material to have been made hydrophobic on their particle surfaces. When the magnetic material is made hydrophobic, it is very preferable to use a method of making surface treatment in an aqueous medium while dispersing magnetic-material particles so as to become primary particles and hydrolyzing a coupling agent. This method of hydrophobic treatment may less cause the mutual coalescence of magnetic-material particles than any treatment made in a gaseous phase. Also, charge repulsion acts between magnetic-material particles themselves as a result of hydrophobic treatment, and hence the magnetic material is surface-treated substantially in the state of primary particles.

The method of surface-treating the magnetic-material particles while hydrolyzing the coupling agent in an aqueous medium does not require any use of coupling agents which may generate gas as in chlorosilanes and silazanes. This method also enables use of highly viscous coupling agents which tend to cause mutual coalescence of magnetic-material particles in a gaseous phase and hence have ever made it difficult to make good treatment. Thus, a great effect of making hydrophobic is obtainable.

The coupling agent usable in the surface treatment of the magnetic material according to the present invention may include, e.g., silane coupling agents and titanium coupling agents. More preferably used are silane coupling agents, which are those represented by the following formula:

$$R_m mSiY_n$$

wherein R represents an alkoxyl group; m represents an integer of 1 to 3; Y represents a functional group such as an alkyl group, a vinyl group, a glycidoxyl group or a methacrylic group; and n represents an integer of 1 to 3.

The silane coupling agents may include, e.g., vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, hyroxypropyltrimethoxysilane, n-hexadecyltrimethoxysilane and n-octadecyltrimethoxysilane.

In particular, in order to attain a sufficient hydrophobic nature, an alkyltrialkoxysilane coupling agent represented by the following formula may more preferably be used in combination.

$$C_pH_{2p+1}—Si—(OC_qH_{2q+1})_3$$

wherein p represents an integer of 2 to 20, and q represents an integer of 1 to 3.

In the above formula, if p is smaller than 2, though hydrophobic treatment may be made with ease, it is difficult to provide a sufficient hydrophobic nature, making it difficult to keep the magnetic-material particles from coming bare to the toner particle surfaces. If on the other hand p is larger than 20, though hydrophobic nature can be sufficient, the magnetic-material particles may greatly coalesce one another to make it difficult to disperse the magnetic-material particles sufficiently in the toner particles, making the toner particles have a little broad particle size distribution. Also, if q is larger than 3, the silane coupling agent may have a low reactivity to make it difficult for the magnetic material to be made sufficiently hydrophobic.

What is more preferable is to use an alkyltrialkoxysilane coupling agent in which, in the above formula, the p represents an integer of 3 to 15 and the q represents an integer of 1 or 2.

In the treatment, the silane coupling agent may be used in a total amount of from 0.05 to 20 parts by weight, preferably from 0.1 to 10 parts by weight, based on 100 parts by weight of the magnetic material. The amount of such a treating agent may preferably be adjusted in accordance with the surface area of the magnetic-material particles and the reactivity of the coupling agent.

The aqueous medium used when the hydrophobic treatment is carried out is a medium composed chiefly of water. Stated specifically, it may include water itself, water to which a surface-active agent has been added in a small quantity, water to which a pH adjuster has been added, and water to which an organic solvent has been added. As the surface-active agent, a nonionic surface-active agent such as polyvinyl alcohol is preferred. The surface-active agent may be added in an amount of from 0.1 to 5% by weight based on the water. The pH adjuster may include inorganic acids such as hydrochloric acid. The organic solvent may include alcohols.

Where plural kinds of silane coupling agents are used, the plural kinds of silane coupling agents may be introduced simultaneously or at intervals of time to treat the magnetic material.

In the magnetic material thus obtained, particles have been kept from agglomerating and the surfaces of individual particles have uniformly been hydrophobic-treated. Hence, the magnetic material can have a good dispersibility in the polymerized monomer.

The magnetic material is chiefly composed of an iron oxide such as triiron tetraoxide or γ-iron oxide, and may also contain any of elements such as phosphorus, cobalt, nickel, copper, magnesium, manganese, aluminum and silicon. Any of these magnetic materials may preferably have a BET specific surface area, as measured by the nitrogen gas absorption method, of from 2 to 30 $m^2/g$, and more preferably from 3 to 28 $m^2/g$. It may further preferably have a Mohs hardness of from 5 to 7.

In the case of the wet-process granulation process carried out by suspension polymerization for example, the magnetic material used in the toner may preferably be used in an amount of from 10 to 200 parts by weight based on 100 parts by weight of the binder resin. It may more preferably be used in an amount of from 20 to 180 parts by weight. If it is less than 10 parts by weight, the toner may have a poor coloring power, and also may make it difficult to keep fog from occurring. If on the other hand it is more than 200 parts by weight, not only it may be difficult for the magnetic material to be uniformly dispersed in individual toner particles, but also the toner obtained may be held on the toner carrying member by magnetic force so strongly as to have a low developing performance or have a low fixing performance.

The content of the magnetic material in the toner may be measured with a thermal analyzer TGA7, manufactured by Perkin-Elmer Corporation. As a measuring method, the toner is heated at a heating rate of 25° C./minute from normal temperature to 900° C. in an atmosphere of nitrogen. The weight loss percent by mass in the course of from 100° C. to 750° C. is regarded as the binder resin weight, and the residual mass is approximately regarded as the magnetic-material weight.

The magnetic material used in the magnetic toner according to the present invention may be, in the case of magnetite for example, produced in the following way. To an aqueous ferrous salt solution, an alkali such as sodium hydroxide is added in an equivalent weight, or more than equivalent weight, with respect to the iron component to prepare an aqueous solution which contains ferrous hydroxide. Into the aqueous solution thus prepared, air is blown while its pH is maintained at pH 7 or above (preferably a pH of 8 to 14), and the ferrous hydroxide is made to undergo oxidation reaction while the aqueous solution is heated at 70° C. or more to first form seed crystals serving as cores of magnetic ion oxide particles.

Next, to a slurry-like liquid containing the seed crystals, an aqueous solution which contains ferrous sulfate in about one equivalent weight on the basis of the quantity of the alkali added previously is added. The reaction of the ferrous hydroxide is continued while the pH of the liquid is maintained at 6 to 14 and while air is blown, to cause magnetic iron oxide particles to grow about the seed crystals as cores. With progress of oxidation reaction, the pH of the liquid comes to shift to acid side, but it is preferable for the pH of the liquid not to be made less than 6. At the termination of the oxidation reaction, the pH is adjusted, and the liquid is thoroughly stirred so that the magnetic iron oxide particles may become primary particles. Then the coupling agent is added, and the mixture obtained is thoroughly mixed and stirred, followed by filtration, drying, and then light disintegration to obtain magnetic iron oxide particles having been hydrophobic-treated. Alternatively, the iron oxide particles obtained after the oxidation reaction is completed, followed by washing and filtration, may be again dispersed in a different aqueous medium without drying, and thereafter the pH of the dispersion again formed may be adjusted, where the silane coupling agent may be added with thorough stirring, to carry out coupling treatment. In any case, it is preferable to carry out the coupling treatment without going through any drying step after the oxidation reaction has been completed.

As the ferrous salt, it is possible to use iron sulfate commonly formed as a by-product in the manufacture of titanium by the sulfuric acid method, or iron sulfate formed as a by-product as a result of surface washing of steel sheets, and is also possible to use iron chloride or the like.

Where the iron sulfate is used in the process of producing the magnetic iron oxide by the aqueous solution method, taking account of preventing viscosity from increasing at the time of reaction and because of solubility of the iron sulfate, its aqueous solution is commonly used in an iron concentration of from 0.5 to 2 mol/l. Commonly, the lower the concentration of iron sulfate is, the finer particle size the products tend to have. Also, in the reaction, the more the air is and the lower the reaction temperature is, the finer particles tend to be formed.

The use of the magnetic toner having as a material the hydrophobic magnetic-material particles produced in this way makes it possible to attain a stable toner chargeability and to achieve a high transfer efficiency and also a high image quality and a high stability.

The magnetic material obtained as described above may preferably be used also as a colorant to be contained in the toner particles. As colorants other than the above magnetic material preferably usable in the toner produced in the present invention, they may include carbon black, and yellow colorants, magenta colorants and cyan colorants shown below.

As colorants preferable for yellow color, pigments or dyes may be used, which may specifically include, as pigments, C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 167, 168, 173, 174, 176, 180, 181, 183 and 191; and C.I., Vat Yellow 1, 3 and 20; and as dyes, C.I. Solvent Yellow 19, 44, 77, 79, 81, 82, 93, 98, 103, 104, 112 and 162. Any of these colorants may be used alone or in combination.

As colorants preferable for magenta color, pigments or dyes may be used, which may specifically include, as pigments, C.I. Pigment Red 1, 2, 3, 4, 5, 6, 7, 8, 9, 10, 14, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238 and 254; C.I. Pigment Violet 19; and C.I. Vat Red 1, 2, 10, 13, 15, 23, 29 and 35; and as dyes, oil-soluble dyes such as C.I. Solvent Red 1, 3, 8, 23, 24, 25, 27, 30, 49, 52, 58, 63, 81, 82, 83, 84, 100, 109, 111, 121 and 122, C.I. Disperse Red 9, C.I. Solvent Violet 8, 13, 14, 21 and 27, and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39 and 40, and C.I. Basic Violet 1, 3, 7, 10, 14, 15, 21, 25, 26, 27 and 28. Any of these colorants may be used alone or in combination of two or more types.

As colorants preferable for cyan color, pigments or dyes may be used, which may specifically include, as pigments, C.I. Pigment Blue 1, 7, 15, 15:1, 15:2, 15:3, 15:4, 16, 17, 60, 62 and 66, C.I. Vat Blue 6 and C.I. Acid Blue 45; and as dyes, C.I. Solvent Blue 25, 36, 60, 70, 93 and 95. Any of these colorants may be used alone or in combination.

Any of these colorants may be used alone, in the form of a mixture of two or more types, or in the state of a solid solution. The colorants used in the present invention are selected taking account of hue angle, chroma, brightness, weatherability, transparency on OHP films and dispersibility in toner particles. The colorant may preferably be added in an amount of from 1 to 20 parts by mass based on 100 parts by mass of the binder resin.

The toner particles may be incorporated with a release agent. The release agent may include, e.g., petroleum waxes and derivatives thereof such as paraffin wax, microcrystalline wax and petrolatum, montan wax and derivatives thereof, hydrocarbon waxes obtained by Fischer-Tropsch synthesis and derivatives thereof, polyolefin waxes typified by polyethylene wax and derivatives thereof, and naturally occurring waxes such as carnauba wax and candelilla wax and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened caster oil and derivatives thereof, vegetable waxes, and animal waxes.

As specific examples, the wax usable as the release agent may include VISKOL (registered trademark) 330-P, 550-P, 660-P, TS-200 (available from Sanyo Chemical Industries, Ltd.); HIWAX 400P, 200P, 100P, 410P, 420P, 320P, 220P, 210P, 110P (available from Mitsui Chemicals, Inc.); SASOL H1, H2, C80, C105, C77 (available from Schumann Sasol Co.); HNP-1, HNP-3, HNP-9, HNP-10, HNP-11, HNP-12 (available from Nippon Seiro Co., Ltd.); UNILIN (registered trademark) 350, 425, 550, 700, UNICID (registered trademark) 350, 425, 550, 700 (available from Toyo-Petrolite Co., Ltd.); and japan wax, bees wax, rice wax, candelilla wax, carnauba wax (available from CERARICA NODA Co., Ltd.).

The toner particles may be mixed with a charge control agent. As the charge control agent, any known charge control agent may be used. Further, in the case of the wet-process granulation process carried out by suspension polymerization for example, when the toner particles are produced, particularly preferred are charge control agents having a low polymerization inhibitory action and substantially free of any solubilizate to the aqueous dispersion medium. As specific compounds, they may include, as negative charge control agents, metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymer type compounds having a sulfonic acid or carboxylic acid group in the side chain; and boron compounds, urea compounds, silicon compounds, and carixarene. As positive charge control agents, they may include quaternary ammonium salts, polymer type compounds having such a quaternary ammonium salt in the side chain, guanidine compounds, Nigrosine compounds and imidazole compounds.

As methods for incorporating the toner with the charge control agent, a method of adding it internally to the toner particles and a method of adding it externally to the toner particles are available. The quantity of the charge control agent to be used depends on the type of the binder resin, the presence of any other additives, and the manner by which the toner is produced, inclusive of the manner of dispersion, and can not absolutely be specified. When added internally, the charge control agent may be used in an amount ranging from 0.1 to 10 parts by mass, and more preferably from 0.1 to 5 parts by mass, based on 100 parts by mass of the binder resin. When added externally, the charge control agent may preferably be added in an amount of from 0.005 to 1.0 part by mass, and more preferably from 0.01 to 0.3 part by mass, based on 100 parts by mass of the toner particles.

In the present invention, in the cases of, e.g., the emulsion polymerization process and the suspension polymerization process, the polymerizable monomer used therefor may include the following: Styrene monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate; dimethylaminoethyl methacrylate and diethylaminoethyl methacrylate; and monomers such as acrylonitrile, methacrylonitrile and acrylamides.

In the cases of the emulsion polymerization process and the suspension polymerization process, the polymerization may be carried out by adding a resin (a high polymer) to the polymerizable monomer. Where a resin containing a hydrophilic functional group such as an amino group, a carboxylic group, a hydroxyl group, a sulfonic acid group, a glycidyl group or a nitrile group, which can not be used because it is water-soluble as a monomer and hence dissolves in an aqueous suspension to cause emulsion polymerization, should be introduced into toner particles, it may be used in the form of a copolymer such as a random copolymer, a block copolymer or a graft copolymer, of a monomer having any of these functional groups, with a vinyl compound such as styrene or ethylene, in the form of a polycondensation product such as polyester or polyamide, or in the form of a polyaddition product such as polyether or polyimine.

An alcohol component and an acid component which are used in the present invention to obtain a polyester resin used in its addition to the polymerizable monomer are exemplified below.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3 hexanediol, cyclohexane dimethanol, butenediol, octenediol, cyclohexene dimethanol, hydrogenated bisphenol A, a bisphenol derivative represented by the following Formula (I) or a hydrogenated product of the compound represented by this Formula (I):

(I)

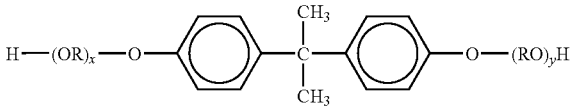

wherein R represents an ethylene group or a propylene group, x and y are each an integer of 1 or more, and an average value of x+y is 2 to 10;

and a diol represented by the following Formula (II) or a hydrogenated product of the compound represented by this Formula (II):

(II)

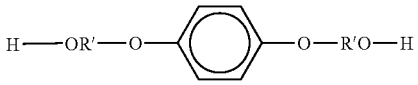

wherein R' represents —$CH_2CH_2$—, —$CH_2CH(CH_3)$—, or —$CH_2$—$C(CH_3)_2$—.

As a dibasic carboxylic acid serving as the acid component, it may include benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, or succinic acid substituted with an alkyl or alkenyl group having 6 to 18 carbon atoms or its anhydrides; and unsaturated dicarboxylic acids such as fumaric acid, maleic acid, citraconic acid and itaconic acid, or anhydrides thereof.

The alcohol component may further include polyhydric alcohols such as glycerol, pentaerythritol, sorbitol, sorbitan, and oxyalkylene ethers of novolak phenol resins; and, as the acid component, polycarboxylic acids such as trimellitic acid, pyromellitic acid, 1,2,3,4-butanetetracarboxylic acid, benzophenonetetracarboxylic acid and anhydrides thereof.

The polyester resin may preferably be composed of from 45 to 55 mol % of the alcohol component and from 55 to 45 mol % of the acid component in the whole components. Also, in the present invention, as long as physical properties of the toner particles to be obtained are not adversely affected, it is also preferable to use two or more types of polyester resins in combination or to regulate physical properties of the polyester resin by modifying it with, e.g., a silicone compound or a fluoroalkyl group-containing compound. In the case when the resin containing such a polar functional group is used, it may preferably have an average molecular weight of 5,000 or more.

A resin other than the foregoing may also be added to the monomer composition. The resin usable therefor may include, e.g., homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl, acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins. Any of these resins may be used alone or in the form of a mixture.

Any of these resins may preferably be added in an amount of from 1 to 20 parts by mass based on 100 parts by mass of the monomer. Its addition in an amount of less than 1 part by mass may be low effective. On the other hand, its addition in an amount of more than 20 parts by mass may make it difficult to design various physical properties of the polymerization toner.

A polymer having molecular weight in a range different from that of the molecular weight of the toner particles obtained by polymerizing the monomer may further be dissolved in the monomer to carry out the polymerization.

Where in the toner particle production process of the present invention a polymerization initiator is used to initiate the reaction of polymerizing the polymerizable monomer, an initiator having a half-life of from 0.5 to 30 hours at the time of polymerization reaction may be added in an amount of from 0.5 to 20 parts by mass based on 100 parts by mass of the polymerizable monomer to carry out the polymerization reaction. This enables production of a polymer having a maximum molecular weight in the region of molecular weight of from 10,000 to 100,000, and enables the toner to be endowed with a desirable strength and appropriate melt properties.

The polymerization initiator may include azo type or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate and t-butyl peroxypivarate.

When the toner particles are produced, a cross-linking agent may be added, which may preferably be added in an amount of from 0.001 to 15 parts by mass based on 100 parts by mass of the polymerizable monomer.

Here, as the cross-linking agent, compounds chiefly having at least two polymerizable double bonds may be used. It may include, e.g., aromatic divinyl compounds such as divinyl benzene and divinyl naphthalene; carboxylic esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture of two or more types.

A specific toner particle production process is described in which, e.g., the suspension polymerization process is selected.

First, the components necessary for toner, such as the colorant, the release agent, a plasticizer, the charge control agent and the cross-linking agent, and other additives as exemplified by an organic solvent, a resin component (a high polymer) and a dispersing agent which are added in order to lower the viscosity of the polymer to be formed by the polymerization reaction, are added to, and uniformly dissolved or dispersed in, the polymerizable monomer to obtain a colorant-containing polymerizable monomer composition. Here, temperature control may optionally be operated. This colorant-containing polymerizable monomer composition is dispersed and suspended in an aqueous medium containing a dispersion stabilizer, to carry out granulation.

Here, at the same time the colorant-containing polymerizable monomer composition is granulated, or after it has been granulated, this composition is polymerized (a polymerization step). When polymerized after the granulation, the polymerization initiator may be added after the granulation.

As specific timing for the addition of the polymerization initiator, it may be added simultaneously when other additives are added to the polymerizable monomer, or may be added and mixed immediately before the colorant-containing polymerizable monomer composition is suspended in the aqueous medium. In the case when the polymerization is initiated after the granulation, the polymerization initiator may be added after the granulation as stated above. A polymerization initiator having been dissolved in an additional polymerizable monomer or in a solvent may also be added during the polymerization reaction.

After the granulation, stirring may be carried out under temperature control and using a conventional stirrer, in such an extent that the state of particles is maintained and also the particles can be prevented from floating and settling.

In producing the toner particles, any known surface-active agent or organic or inorganic dispersant may be used as a dispersion stabilizer. In particular, the inorganic dispersant can not easily cause any harmful ultrafine powder and it attains dispersion stability on account of its steric hindrance. Hence, even when reaction temperature is changed, it can not easily loose the stability, and hence it is preferred. As examples of such an inorganic dispersant, it may include phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; inorganic hydroxides such as calcium hydroxide, magnesium hydroxide and aluminum hydroxide; and inorganic oxides such as silica, bentonite and alumina.

Any of these inorganic dispersants may preferably be used alone in an amount of from 0.2 to 20 parts by mass based on 100 parts by mass of the polymerizable monomer. A surface-active agent may also be used in combination in an amount of from 0.001 to 0.1 part by mass based on 100 parts by mass of the polymerizable monomer.

Such a surface-active agent may include, e.g., sodium dodecylbenzenesulfonate, sodium tetradecyl sulfate, sodium pentadecyl sulfate, sodium octyl sulfate, sodium oleate, sodium laurate, sodium stearate and potassium stearate.

When these inorganic dispersants are used, they may be used as they are. In order to obtain finer particles, particles of the inorganic dispersant may be formed in the aqueous medium. For example, in the case of calcium phosphate, an aqueous sodium phosphate solution and an aqueous calcium chloride solution may be mixed under high-speed stirring, whereby water-insoluble calcium phosphate can be formed and more uniform and finer dispersion can be effected. Here, water-soluble sodium chloride is simultaneously formed as a by-product. However, the presence of such a water-soluble salt in the aqueous medium keeps the polymerizable monomer from dissolving in water to make any ultrafine toner particles not easily formed by emulsion polymerization, and hence this is more favorable. The inorganic dispersant may substantially completely be removed through the subsequent steps such as filtration and washing, by dissolving it with an acid or an alkali after the polymerization is completed.

In the step of the above polymerization, the polymerization may be carried out at a polymerization temperature set at 40° C. or above, and commonly at a temperature of from 50 to 90° C. Inasmuch as the polymerization is carried out within this temperature range, the release agent or wax and something else to be enclosed inside the toner particles comes deposited by phase separation to come enclosed more perfectly. In order to consume residual polymerizable monomers, the reaction temperature may be raised to 90 to 150° C. at the termination of polymerization reaction. After the polymerization is completed, the toner particle dispersion obtained is filtered and washed by means of the belt filter having the pressing aeration mechanism according to the present invention, followed by drying preferably by means of an air dryer.

Commonly, the toner particles thus obtained are put to the step of classification, where any coarse powder and fine powder with particle diameter outside the desired range are removed. The classification step may be carried out by any known method used conventionally in the production of toners, without any particular limitations. The toner particles obtained through the classification step may be mixed with an external additive such as an inorganic fine powder to make it adhere to the toner particle surfaces, to obtain a toner.

In the present invention, the classification step may be omitted from the production steps to obtain the toner directly, or a further highly precise classification step may be carried out to remove any coarse powder and fine powder in a good efficiency. This is also one of desirable embodiments.

In the present invention, to the toner particles, a fluidity-providing agent may preferably be added as an external additive. A preferred fluidity-providing agent may include inorganic fine particles having a number average primary particle diameter of from 4 nm to 80 nm.

As the inorganic fine particles, usable are fine particles of silica, alumina, titanium oxide and so forth. For example, as fine silica particles, usable are what is called dry-process silica or fumed silica produced by vapor phase oxidation of silicon halides and what is called wet-process silica produced from water glass or the like, either of which may be used. The dry-process silica is preferred, as having less silanol groups present on the particle surfaces and interiors of the fine silica particles and leaving less production residues such as $Na_2O$ and $SO_3^-$. Also, in the case of the dry-process silica, in the production step therefor, other metal halide such as aluminum chloride or titanium chloride for example may be used together with the silicon halide to obtain a composite fine powder of silica with other metal oxide. The dry-process silica includes these as well.

The inorganic fine particles may preferably be added in an amount of from 0.1 to 3.0% by mass based on the mass of the toner base particles. In their addition in an amount of less than 0.1% by mass, the effect to be brought by their addition may be insufficient. Their addition in an amount of more than 3.0% by mass may make the toner have a low fixing performance. The content of the inorganic fine particles may be determined by fluorescent X-ray analysis and using a calibration curve prepared from a standard sample.

Taking account of properties in a high-temperature and high-humidity environment, the inorganic fine particles may preferably be those having been hydrophobic-treated. As a treating agent used for such hydrophobic treatment, usable are a silicone varnish, a modified silicone varnish of various types, a silicone oil, a modified silicone oil of various types, a silane compound, a silane coupling agent, other organosilicon compound and an organotitanium compound; any of which may be used alone or in combination.

As a method for such treatment of the inorganic fine particles, for example a method is available in which silylation reaction is effected as first-stage reaction to cause silanol groups to disappear by chemical coupling, and thereafter, as second-stage reaction, the silicone oil is added to form hydrophobic thin films on particle surfaces.

Such a silicone oil may preferably be one having a viscosity at 25° C. of from 10 to 200,000 $mm^2/s$, and more preferably from 3,000 to 80,000 $mm^2/s$. If its viscosity is less than 10 $mm^2/s$, the inorganic fine particles may have no stability, and the image quality tends to deteriorate because of thermal and mechanical stress. If its viscosity is more than 200,000 $mm^2/s$, it tends to be difficult to carry out uniform treatment.

As the silicone oil used, particularly preferred are, e.g., dimethylsilicone oil, methylphenylsilicone oil, α-methylstyrene modified silicone oil, chlorophenylsilicone oil and fluorine modified silicone oil.

As a method for treating the inorganic fine particles with the silicone oil, for example inorganic fine particles having been treated with a silane compound and the silicone oil may directly be mixed by means of a mixer such as Henschel mixer, or a method may be used in which the silicone oil is sprayed on the inorganic fine particles. Alternatively, a method may also be used in which the silicone oil is dissolved or dispersed in a suitable solvent and thereafter the inorganic fine particles are added thereto and mixed, followed by removal of the solvent. In view of an advantage that agglomerates of the inorganic fine particles may less form, the method making use of a sprayer is preferred.

The silicone oil may be used for the treatment in an amount of from 1 to 40 parts by mass, and preferably from 3 to 35 parts by mass, based on 100 parts by mass of the inorganic fine particles.

In the case when the fine silica particles are used, in order for the toner to be provided with a good fluidity, the fine silica particles may preferably be those having a specific surface area ranging from 20 to 350 $m^2/g$, and more preferably from 25 to 300 $m^2/g$, as measured by the BET method utilizing nitrogen absorption.

The specific surface area is measured according to the BET method, where nitrogen gas is adsorbed on sample surfaces using a specific surface area measuring instrument AUTOSOBE 1 (manufactured by Yuasa Ionics Co.), and the specific surface area is calculated by the BET multiple point method.

In order to improve cleaning performance and so forth, inorganic or organic closely spherical fine particles having a primary particle diameter of more than 30 nm (more preferably a primary particle diameter of 50 nm or more) may be added to the toner particles as an external additive. This is also one of preferred embodiments. As the inorganic or organic fine particles, preferably usable are those having a specific surface area of less than 50 $m^2/g$ (more preferably having a specific surface area of less than 30 $m^2/g$). As such fine particles, preferably usable are, e.g., spherical silica particles, spherical polymethyl silsesquioxane particles and spherical resin particles.

Other external additives may further be used by their addition to the toner particles as long as they substantially do not adversely affect the toner. Such external additives may include, e.g., lubricant powders such as polyethylene fluoride powder, zinc stearate powder and polyvinylidene fluoride powder; abrasives such as cerium oxide powder, silicon carbide powder and strontium titanate powder; fluidity-providing agents such as titanium oxide powder and aluminum oxide powder; and caking preventives. Also usable are reverse-polarity organic fine particles or inorganic fine particles which may be used in a small quantity as a developability improver. These additives may also be used after hydrophobic treatment of their particle surfaces.

The toner having the toner particles which have been produced in the present invention may be used as a one-component developer, or may be blended with a magnetic carrier so as to be used as a two-component developer.

The magnetic carrier may be made up using any element selected from iron, copper, zinc, nickel, cobalt, manganese and chromium, solely or in the state of a composite ferrite. As the particle shape of the magnetic carrier, it may be spherical, flat or shapeless (amorphous). It is further preferable to control the microstructure of magnetic carrier particle surface state (e.g., surface unevenness). As a method for producing the carrier, what is commonly used is a method in which an inorganic oxide of the foregoing is fired and granulated to beforehand produce magnetic carrier core particles, and thereafter the resultant carrier core particles are coated with a resin. For the purpose of lessening the load of magnetic carrier to toner, it is also possible to use a method in which the inorganic oxide and the resin are kneaded, followed by pulverization and then classification to obtain a low-density dispersed carrier, or a method in which a kneaded product of the inorganic oxide and monomers is directly subjected to suspension polymerization in an aqueous medium to obtain a truly spherical magnetic carrier.

Of these, a coated carrier obtained by coating the surfaces of the above carrier core particles with a resin is particularly preferred. As methods for coating the surfaces of the carrier core particles with a resin, applicable, are a method in which a resin dissolved or suspended in a solvent is coated to make it adhere to carrier core particles, and a method in which a resin powder and the carrier core particles are merely mixed to make the former adhere to the latter.

The substance with which the carrier particle surfaces are to be coated may differ depending on toner materials. For example, it may include, e.g., polytetrafluoroethylene, monochlorotrifluoroethylene polymer, polyvinylidene fluoride; silicone resins, polyester resins, styrene resins, acrylic resins, polyamide, polyvinyl butyral, and aminoacrylate resins. Any of these may be used alone or in plurality.

The carrier may be one having the following magnetic characteristics: Its magnetization intensity ($\sigma_{1000}$) under application of a magnetic-field intensity of 79.6 kA/m (1,000 oersteds) after it has magnetically been saturated may preferably be from 3.77 to 37.7 $\mu Wb/cm^3$. In order to achieve a much higher image quality, it may more preferably be from 12.6 to 31.4 $\mu Wb/cm^3$. If this magnetization intensity is more than 37.7 $\mu Wb/cm^3$, it may be difficult to obtain toner images having a high image quality. If on the other hand it is less than 3.77 $\mu Wb/cm^3$, the carrier may also have less magnetic binding force to tend to cause carrier adhesion.

In the case when the toner used in the present invention is blended with the magnetic carrier to prepare the two-component developer, they may be blended in a ratio such that the toner in the developer is in a concentration of from 2 to 15% by mass, and preferably from 4 to 13% by mass, where good results can usually be obtained.

Each measuring method used in the present invention is described below.

(1) Measurement of Particle Size Distribution of Toner:

The particle size distribution of toners may be measured by various methods. In the present invention, it may preferably be measured with a Coulter counter.

Coulter Counter Multisizer Model I, Model II or Model IIe (manufactured by Coulter Electronics, Inc.) is used as a measuring instrument. An interface (manufactured by Nikkaki k.k.) that outputs number average distribution and volume average distribution and a commonly available personal computer are connected. As an electrolytic solution, an aqueous 1% NaCl solution is prepared using guaranteed or first-grade sodium chloride.

Stated specifically, from 0.1 to 5 ml of a surface active agent (preferably sodium dodecylbenzene sulfonate) is added as a dispersant to from 100 to 150 ml of the above aqueous electrolytic solution, and further from 2 to 20 mg of a sample to be measured is added. The electrolytic solution in which the sample has been suspended is subjected to dispersion for about 1 minute to about 3 minutes in an ultrasonic dispersion machine. The particle size distribution of toner particles of from 2 to 40 μm in diameter is measured based on the number, by means of the above Coulter Counter Multisizer Model TA-II and using an aperture of 100 μm as its aperture.

(2) Evaluation of How Wet Toner Particles Stand Washed:

The state of washing is evaluated by the quantity of the dispersion stabilizer remaining on the surfaces of wet toner particles. In regard to the quantity of the residual dispersion stabilizer, it is quantitatively analyzed with a fluorescent X-ray analyzer (RIX 3000). In this measuring instrument, as a toner sample, a pellet of 40 mm in diameter is prepared using a tableting machine under a pressure of 159 $N/mm^2$. A target (a spectral crystal, e.g., Rh, for spectrally dispersing fluorescent X-rays emitted from the sample) is appropriately set, and measurement is made under conditions of, e.g., a tube voltage of 40 kV, a tube current of 90 mA and a 2θ angle of 144.7 degrees to measure the stated metallic elements in the toner sample by fluorescent X-ray analysis. The results of this measurement and calibration curves prepared beforehand on the metallic elements that should be determined are used to determine the metallic elements quantitatively. This quantity of the residual dispersion stabilizer may preferably be 180 ppm or less from the viewpoint of chargeability.

(3) Measurement of Water Content:

The water content in the present invention is the value found when 5 g of wet toner particles are collected in an aluminum pan, which are precisely so weighed (A (g)) and left for 1 hour in a dryer set at 105° C., and the particles having been cooled are precisely weighed (B (g)) to make calculation according to the following expression:

$$\text{Water content (\%)}=((A-B)/A)\times 100.$$

EXAMPLES

The present invention is described below in greater detail by giving Examples, which, however, by no means limit the present invention.

Example 1

In 700 parts by mass of ion-exchanged water, 450 parts by mass of an aqueous 0.1 mol/liter $Na_3PO_4$ solution was introduced, followed by heating to 60° C. and thereafter stirring at 4,500 rpm by means of CLEAMIX CLS-30S (manufactured by $M_{TECHNIQUE}$ Co., Ltd.). To the resultant mixture, 68 parts by mass of an aqueous 1.0 mol/liter $CaCl_2$ solution was added to obtain an aqueous medium containing calcium phosphate.

| Monomers: | (by mass) |
|---|---|
| Styrene | 170 parts |
| n-Butyl acrylate | 30 parts |
| Colorant: C.I. Pigment Blue 15:3 | 10 parts |
| Charge control agent: BONTRON E-88 (available from Orient Chemical Industries, Ltd.) | 2 parts |
| Polar resin: Saturated polyester (polycondensation product of propylene oxide modified bisphenol A (2 mol addition product) and terephthalic acid (molar ratio: 10:12); Tg: 68° C.; Mw: 10,000; Mw/Mn: 5.12) | 15 parts |
| Release agent: Hydrocarbon wax (Mn: 850; melting point: 107° C.; penetration at 25° C.: 1) | 6 parts |

Meanwhile, materials formulated as shown above were heated to 60° C. and uniformly dissolved and dispersed. To the mixture obtained, 8 parts by mass of a polymerization initiator 2,2'-azobis(2,4-dimethylvaleronitrile) was dissolved to prepare a colorant-containing polymerizable monomer composition.

This colorant-containing polymerizable monomer composition was introduced into the above aqueous medium, and these were stirred at 60° C., in an atmosphere of nitrogen and at 4,500 rpm for 15 minutes by means of CLEAMIX to granulate the colorant-containing polymerizable monomer composition.

Thereafter, with stirring by means of a full-zone stirring blade (manufactured by Shinko Pantec Co., Ltd.), the granulated product was heated to 70° C. and reacted for 10 hours. After the polymerization reaction was completed, saturated steam (pure steam; steam pressure: 205 kPa; temperature: 120° C.) was fed into the system while the stirring was continued using the full-zone stirring blade. On lapse of 20 minutes after the feeding of the saturated steam was started, the temperature of the contents in the reaction vessel reached 100° C., and distillation fractions began to come separated. Fractions were obtained in the stated quantity and the residual monomers were evaporated off, followed by cooling to obtain a toner particle dispersion.

To this toner particle dispersion, hydrochloric acid was added to dissolve calcium phosphate remaining on the toner particle surfaces. The resultant toner-particle containing slurry had a bulk density of 0.65 kg/l.

The toner-particle-containing slurry thus obtained was introduced into the defoamer embodied as shown in FIG. 4, to defoam the slurry under the following conditions.

Main-body volume: 10 liters.

Peripheral speed of rotary disk: 17 m/s.

Slurry feed rate: 180 liters/hour.

Degree of vacuum: 20 kPa.

Next, using a discharge pump, the slurry (the matter to be filtered) was continuously discharged out of the defoamer, and was continuously fed at a rate of 140 kg/hour to the belt filter having the pressing aeration mechanism as shown in FIGS. 1 to 3 (an altered model of a synchronous filter, manufactured by Tsukishima Kikai Co., Ltd.), to dehydrate and wash the slurry under the following conditions to obtain cakes of the wet toner particles. The slurry fed to the belt filter through the pump had a bulk density of 1.0 kg/liter.

—Conditions for Dehydration and Washing by Means of Belt Filter of Pressing Aeration Mechanism System—

Slurry feed rate: 140 kg/hour.

Belt speed: Operated at stop time/move time=10/1; 0.7 m/minute on the average).

Amount of washing water: 50 kg/hour.

Degree of vacuum: −70 kPa (evacuated to 70 kPa from atmospheric pressure).

Sealing pressure (the pressure at which the elastic portion was pressed against the filter cloth): 400 kPa.

Width of elastic portion (at upstream and downstream portions in the direction of onward movement): 100 mm.

Width of elastic portion (side portions): 90 mm.

Compressed gas: Compressed air.

Aeration pressure: 200 kPa.

Aeration rate: 0.04 $m^3/m^2 \cdot s$.

Rubber material: Chloroprene rubber.

Rubber hardness: 20 degrees.

Pressing time: 70 seconds (the pressing aeration mechanism was placed on the final stage, and the cakes were pressed for 70 seconds in the 75 seconds for which the belt stopped at the final stage).

Aeration time: 60 seconds (aerated for 60 seconds in the pressing time 70 seconds).

The wet toner particles thus obtained had a water content of 20%. How the wet toner particles stood washed here was also analyzed with the fluorescent X-ray analyzer described previously, to find that the remaining dispersion stabilizer was in a level of 100 ppm, showing good results.

Thereafter, the cakes of the wet toner particles were disintegrated, and then air-dried under the following conditions by using an air dryer (Flash Jet Dryer, manufactured by Seishin Enterprise Co., Ltd.; piping diameter: 0.1016 m), to obtain toner particles.

—Air Dryer Drying Conditions—

Blowing temperature: 90° C.

Blowing air flow: 10 $m^3$/min.

Wet toner particle feed rate: 50 kg/hour.

To 100 parts by mass of the toner particles thus obtained, 1.0 part by mass of hydrophobic silica having a specific surface area of 200 $m^2$/g as measured by the BET method was externally added, and these were mixed by means of a mixer to obtain a toner. The toner obtained in this Example had a weight average particle diameter (D4) of 6.8 μm.

—Evaluation of Image Quality—

A continuous 3,000-sheet running test was conducted in an environment of temperature 30° C. and humidity 80%. The degree of fog at printing on 3,000 sheets was measured to make evaluation. The running test was conducted using a laser beam printer LBP-2360, manufactured by CANON, INC.

As to fog on paper, it was measured with a reflection densitometer (REFLECTOMETER MODEL TC-6DS, manufactured by Tokyo Denshoku Co., Ltd.). More specifically, when the worst value of reflection densities at white background areas after printing as measured with the reflection densitometer was represented by Ds, and the average value of reflection densities measured with the reflection densitometer on sheets before printing by Dr, the difference in these values, Ds−Dr, was found to regard it as the fog on paper. Where the level of this fog on paper was 2% or less, images were good images substantially free of any fog on paper. Where, however, it was more than 2%, images were unclear images in which the fog on paper was conspicuous.

The evaluation on fog was indicated according to the following ranks. The results of evaluation are shown in Table 1.

A: Good.

B: Much fog to make images unclear.

Example 2

A toner was produced in the same manner as in Example 1 except that, in the dehydration and washing conditions in Example 1, the slurry feed rate was changed to 180 kg/hour, and the evaluation was made in the same way as in Example 1. The results are shown in Table 1.

Example 3

A toner was produced in the same manner as in Example 1 except that, in the dehydration and washing conditions in Example 1, the aeration pressure was changed to 600 kPa, the aeration rate to 0.2 $m^3/m^2 \cdot s$ and the sealing pressure to 800 kPa, and the evaluation was made in the same way as in Example 1. The results are shown in Table 1.

Example 4

A toner was produced in the same manner as in Example 1 except that, in the dehydration and washing conditions in Example 1, the aeration pressure was changed to 100 kPa and the aeration rate to 0.02 $m^3/m^2 \cdot s$, and the evaluation was made in the same way as in Example 1. The results are shown in Table 1.

Example 5

A toner was produced in the same manner as in Example 1 except that, in the dehydration and washing conditions in Example 1, the sealing pressure was changed to 800 kPa, and the evaluation was made in the same way as in Example 1. The results are shown in Table 1.

Example 6

A toner was produced in the same manner as in Example 1 except that, in the dehydration and washing conditions in Example 1, the chloroprene rubber used was changed for one having a rubber hardness of 30 degrees, and the evaluation was made in the same way as in Example 1. The results are shown in Table 1.

Example 7

A toner was produced in the same manner as in Example 1 except that, in the dehydration and washing conditions in Example 1, the elastic portion of the pressing aeration means was changed for one being 50 mm in width for all four sides, and the evaluation was made in the same way as in Example 1. The results are shown in Table 1.

Example 8

A toner was produced in the same manner as in Example 1 except that, in the dehydration and washing conditions in Example 1, the chloroprene rubber used was changed for one having a rubber hardness of 50 degrees, and the evaluation was made in the same way as in Example 1. The results are shown in Table 1.

Example 9

A toner was produced in the same manner as in Example 1 except that, in the dehydration and washing conditions in Example 1, the elastic portion of the pressing aeration means was changed for one being 350 mm in width in regard to upstream and downstream portions in the direction of onward movement and 50 mm in width in regard to side portions, and the evaluation was made in the same way as in Example 1. The results are shown in Table 1.

Example 10

A toner was produced in the same manner as in Example 1 except that, in the dehydration and washing conditions in Example 1, the elastic portion, of the pressing aeration means was changed for one being 50 mm in width in regard to upstream and downstream portions in the direction of onward movement and 350 mm in width in regard to side portions, and the evaluation was made in the same way as in Example 1. The results are shown in Table 1.

Comparative Example 1

In the dehydration and washing conditions in Example 1, the procedure of Example 1 was repeated but without operating the pressing aeration mechanism. As the result, the wet toner particles had a water content of as very high as 35%, and hence the rate of feed of the wet toner particles to the air dryer was dropped to 25 kg/hour. Except the foregoing, a toner was produced in the same manner as in Example 1, and the evaluation was made in the same way as in Example 1. The results are shown in Table 1.

Example 11

A toner was produced in the same manner as in Example 1 except that the defoamer embodied as shown in FIG. 5 was used.

Conditions under which the defoamer shown in FIG. 5 was operated were as follows:

Number of revolutions of rotary container: 2,000 rpm.

Slurry feed rate: 2,000 kg/hour.

Degree of vacuum: 5 kPa.

The toner slurry before defoaming treatment had a bulk density of 0.65 kg/liter, and the slurry fed to the filtering machine after the defoaming was completed had a bulk density of 1.01 kg/liter.

The evaluation was also made in the same way as in Example 1. The results are shown in Table 1.

Example 12

In 700 parts by mass of ion-exchanged water, 450 parts by mass of an aqueous 0.1 mol/liter $Na_3PO_4$ solution was introduced, followed by heating to 60° C. and thereafter stirring at 4,500 rpm by means of CLEAMIX CLS-30S (manufactured by $M_{TECHNIQUE}$ Co., Ltd.). To the resultant mixture, 68 parts by mass of an aqueous 1.0 mol/liter $CaCl_2$ solution was added to obtain an aqueous medium containing calcium phosphate.

| Monomers: | (by mass) |
|---|---|
| Styrene | 170 parts |
| n-Butyl acrylate | 40 parts |
| Colorant: Magnetic material obtained, by the process shown below | 180 parts |
| Charge control agent: BONTRON E-88 (available from Orient Chemical Industries, Ltd.) | 2 parts |
| Polar resin: Saturated polyester (polycondensation product of propylene oxide modified bisphenol A (2 mol addition product) and terephthalic acid (molar ratio: 10:12); Tg: 68° C.; Mw: 10,000; Mw/Mn: 5.12) | 15 parts |
| Release agent: Hydrocarbon wax (Mn: 850; melting point: 107° C.; penetration at 25° C.: 1) | 5 parts |

The magnetic material used here was produced in the following way.

Production of Magnetic Material

In an aqueous ferrous sulfate solution, 1.0 to 1.1 equivalent weight of a sodium hydroxide solution, based on iron element, 1.5% by mass of sodium hexametaphosphate in terms of phosphorus element, based on iron element, and 1.5% by mass of sodium silicate in terms of silicon element, based on iron element, were mixed to prepare an aqueous solution containing ferrous hydroxide.

Keeping this aqueous solution at a pH of 9, air was blown into it, and oxidation reaction was carried out at 80 to 90° C. to prepare a slurry solution from which seed crystals were to be formed.

Next, an aqueous ferrous sulfate solution was so added to this slurry solution as to be from 0.9 to 1.2 in equivalent weight based on the initial alkali quantity (sodium component of sodium hydroxide). Thereafter, the slurry was kept at a pH of 8, and air was blown into it, during which the oxidation reaction was allowed to proceed to obtain a slurry containing magnetic iron oxide. This slurry was filtered and washed. Then, this water-containing slurry was re-dispersed in a different aqueous medium. Thereafter, the pH of the fluid re-dispersion was adjusted to about 4.5, and, with thorough stirring, n-hexyltrimethoxysilane was added thereto in an amount of 2.0 parts by mass based on 100 parts by mass of the magnetic iron oxide, to carry out hydrolysis. Thereafter, the pH of the fluid dispersion was adjusted to about 10, where condensation reaction was carried out and coupling treatment was carried out. The hydrophobic magnetic fine particles thus formed were washed, filtered and dried by conventional methods, and the resultant particles were subjected to disintegration treatment. The magnetic fine particles thus obtained had a volume average particle diameter of 0.20 μm.

Materials formulated as shown above were heated to 60° C. and uniformly dissolved and dispersed. To the mixture obtained, 8 parts by mass of a polymerization initiator tert-butyl peroxypivarate was dissolved to prepare a magnetic-material-containing polymerizable monomer composition.

Next, this magnetic-material-containing polymerizable monomer composition was introduced into the above aqueous medium, and these were stirred at 60° C., in an atmosphere of nitrogen and at 4,500 rpm for 15 minutes by means of CLEAMIX to granulate the magnetic-material-containing polymerizable monomer composition.

Thereafter, with stirring by means of a full-zone stirring blade (manufactured by Shinko Pantec Co., Ltd.), the granulated product was heated to 70° C. and reacted for 8 hours. After the polymerization reaction was completed, saturated steam (pure steam; steam pressure: 205 kPa; temperature: 120° C.) was fed into the system while the stirring was continued using the full-zone stirring blade. On lapse of 20 minutes after the feeding of the saturated steam was started, the temperature of the contents in the reaction vessel reached 100° C., and distillation fractions began to come separated. Fractions were obtained in the stated quantity and the residual monomers were evaporated off, followed by cooling to obtain a magnetic toner particle dispersion.

The subsequent procedure of Example 1 was repeated except that the slurry feed rate was changed to 200 kg/hour, to obtain magnetic toner particles.

100 parts by mass of the magnetic toner particles obtained and 1.0 part by mass of hydrophobic fine silica powder (number average primary particle diameter: 12 nm) obtained by treating fine silica particles of 12 nm in number average primary particle diameter (BET specific surface area: 180 $m^2/g$) with hexamethyldisilazane and thereafter treated with silicone oil and having a BET specific surface area of 120 $m^2/g$ after treatment were mixed by means of Henschel mixer (manufactured by Mitsui Miike Engineering Corporation) to obtain a magnetic toner. The toner obtained in this Example had a weight average particle diameter of 6.4 μm.

—Evaluation of Image Quality—

To evaluate image characteristics, a continuous 5,000-sheet running test was conducted in an environment of temperature 30° C. and humidity 80%, and fog was measured. The running test was conducted using a laser, beam printer LBP-1760, manufactured by CANON, INC.

Evaluation was made in the same way as in Example 1 except that the above LBP-1760 was used and images were printed on sheets the number of which was changed to 5,000.

In this Example, images after the 5,000-sheet running were evaluated, where the fog was on the level of no problem throughout the running.

Comparative Example 2

In the dehydration and washing conditions in Example 12, the procedure of Example 12 was repeated but without operating the pressing aeration mechanism. As the result, the wet toner particles had a water content of as very high as 37%, and hence the rate of feed of the wet toner particles to the air dryer was dropped to 25 kg/hour. Except the foregoing, a toner was produced in the same manner as in Example 12, and the evaluation was made in the same way. The results are shown in Table 1.

TABLE 1

| | Colorant | Sealing pressure (kPa) | Rubber hardness (deg) | Sealing width (1) (mm) | Sealing width (2) (mm) | Aeration pressure (kPa) | Aeration rate ($m^3/m^2 \cdot s$) | Slurry feed rate (kg/hr) | Water content % | Residual dispersant level (ppm) | Toner wt. av. particle diam. (μm) | Fog evaluation |
|---|---|---|---|---|---|---|---|---|---|---|---|---|
| Example: | | | | | | | | | | | | |
| 1 | PB 15:3 | 400 | 20 | 100 | 90 | 200 | 0.04 | 140 | 20 | 100 | 6.8 | A |
| 2 | PB 15:3 | 400 | 20 | 100 | 90 | 200 | 0.04 | 180 | 21 | 105 | 6.8 | A |
| 3 | PB 15:3 | 800 | 20 | 100 | 90 | 600 | 0.2 | 140 | 18 | 85 | 6.8 | A |
| 4 | PB 15:3 | 400 | 20 | 100 | 90 | 100 | 0.02 | 140 | 23 | 130 | 6.8 | A |
| 5 | PB 15:3 | 800 | 20 | 100 | 90 | 200 | 0.04 | 140 | 20 | 95 | 6.8 | A |
| 6 | PB 15:3 | 400 | 30 | 100 | 90 | 200 | 0.04 | 140 | 21 | 100 | 6.8 | A |
| 7 | PB 15:3 | 400 | 20 | 50 | 50 | 200 | 0.04 | 140 | 20 | 95 | 6.8 | A |
| 8 | PB 15:3 | 400 | 50 | 100 | 90 | 200 | 0.04 | 140 | 27 | 160 | 6.8 | A |
| 9 | PB 15:3 | 400 | 20 | 350 | 50 | 200 | 0.04 | 140 | 28 | 180 | 6.8 | A |
| 10 | PB 15:3 | 400 | 20 | 50 | 350 | 200 | 0.04 | 140 | 29 | 190 | 6.8 | A |
| 11 | PB 15:3 | 400 | 20 | 100 | 90 | 200 | 0.04 | 140 | 21 | 95 | 6.8 | A |
| Comparative Example: | | | | | | | | | | | | |

TABLE 1-continued

| | Colorant | Sealing pressure (kPa) | Rubber hardness (deg) | Sealing width (1) (mm) | Sealing width (2) (mm) | Aeration pressure (kPa) | Aeration rate ($m^3/m^2 \cdot s$) | Slurry feed rate (kg/hr) | Water content % | Residual dispersant level (ppm) | Toner wt. av. particle diam. (μm) | Fog evaluation |
|---|---|---|---|---|---|---|---|---|---|---|---|---|
| 1 | PB 15:3 | 0 | — | — | — | 0 | — | 140 | 35 | 220 | 6.8 | B |
| Example: | | | | | | | | | | | | |
| 12 | Magnetic material | 400 | 20 | 100 | 90 | 200 | 0.04 | 200 | 24 | 130 | 6.4 | A |
| Comparative Example: | | | | | | | | | | | | |
| 2 | Magnetic material | 0 | — | — | — | 0 | — | 200 | 37 | 230 | 6.4 | B |

PB: Pigment Blue
(1): (at upstream and downstream portions)
(2): (at side portions)

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2005-220272, filed Jul. 29, 2005, and 2005-220277, filed Jul. 29, 2005, which are hereby incorporated by reference herein in their entirety.

What is claimed is:

1. A process for producing toner particles in a liquid dispersion medium; the process being a toner particle production process comprising:

(a) forming a slurry which contains toner particles; and (b) subjecting the slurry to a filtering step for solid-liquid separation by means of a belt filter having a pressing aeration means which carries out aeration with pressing, to form wet toner particle cakes, wherein said filtering step which forms the wet toner particle cakes comprises the steps, in sequence, of (i) dehydrating the slurry which contains toner particles, to obtain toner particle cakes;

(ii) washing the resultant toner particle cakes to obtain wash-water-containing toner particle cakes; and (iii) subjecting the wash-water-containing toner particle cakes to aeration with pressure by said pressing aeration means to obtain said wet toner particle cakes.

2. The process for producing toner particles according to claim 1, which comprises a drying step for drying the wet toner particle cakes obtained through said filtering step.

3. The process for producing toner particles according to claim 2, wherein said drying step is the step of airborne drying in which said wet toner particle cakes are dispersed in hot-air streams and in the form of powder particles so as to be dried while being sent in flows parallel with the hot-air streams.

4. The process for producing toner particles according to claim 1, wherein said pressing aeration means has a perforated portion with holes through which at least aeration is performed, and has an elastic portion having elasticity, which surrounds the perforated portion and is so provided as to come into contact with a filter cloth of said belt filter at the time of aeration.

5. The process for producing toner particles according to claim 4, wherein a member constituting said elastic portion is formed of a soft rubber, and has rubber hardness F (degree) of:

$$10 \leqq F \leqq 40.$$

6. The process for producing toner particles according to claim 5, wherein said member constituting said elastic portion is formed of chloroprene rubber.

7. The process for producing toner particles according to claim 4, wherein compressed air is passed through said perforated portion.

8. The process for producing toner particles according to claim 7, wherein said compressed air has pressure P1 (kPa) of:

$$10 \leqq P1 \leqq 900.$$

9. The process for producing toner particles according to claim 7, wherein said perforated portion affords aeration rate G per unit area and unit time ($m^3/m^2 \cdot s$) of:

$$0.01 \leqq G \leqq 0.50.$$

10. The process for producing toner particles according to claim 4, wherein, at the time of aeration, said elastic portion is kept in pressure contact with said filter cloth so that the air passed through said perforated portion does not leak from the pressing aeration part; the pressure contact being at pressure P2 (kPa) of:

$$20 \leqq P2 \leqq 1{,}000.$$

11. The process for producing toner particles according to claim 1, wherein said liquid dispersion medium for dispersing the toner particles therein is an aqueous dispersion medium.

12. The process for producing toner particles according to claim 1, wherein said toner particles contained in said slurry are toner particles formed by polymerizing in an aqueous medium a polymerizable monomer composition containing at least a polymerizable monomer and a colorant.

13. The process for producing toner particles according to claim 12, wherein said colorant is constituted of a non-magnetic material.

14. The process for producing toner particles according to claim 12, wherein said colorant is a magnetic fine powder having been treated with a silane coupling agent.

15. The process for producing toner particles according to claim 1, wherein said belt filter is a vacuum belt filter in which, at the time of vacuum filtration, a filter cloth and a vacuum tray do not rub against each other in the state of being evacuated.

16. The process for producing toner particles according to claim 1, wherein said belt filter is a filter cloth intermittent movement type belt filter.

17. The process for producing toner particles according to claim 16, wherein said pressing aeration means is capable of coming into contact with and separating from the wet toner particle cakes, and said pressing aeration means interlocks with intermittent movement of the filter cloth of said filter cloth intermittent movement type belt filter.

18. The process for producing toner particles according to claim 4, wherein said elastic portion has width D (mm) around the perforated portion, of:

$$30 \leqq D \leqq 300.$$

19. The process for producing toner particles according to claim 1, wherein said wet toner particle cakes after the filtering step making use of said belt filter has a water content of 30% or less.

20. The process for producing toner particles according to claim 1, wherein the matter to be filtered that is to be fed to the filtering step is a slurry containing the toner particles having been subjected to defoaming treatment in a defoaming step.

21. The process for producing toner particles according to claim 20, wherein said defoaming treatment is the step of feeding to an evacuatable container the slurry containing the toner particles, to carry out vacuum treatment.

22. The process for producing toner particles according to claim 20, wherein said vacuum treatment is carried out under a reduced pressure of from 5 to 50 kPa.

23. The process for producing toner particles according to claim 20, wherein said defoaming treatment is the step of so treating the slurry as to satisfy the following relationship of:

$$1.05 \leqq A/C \leqq 3.00$$

where the bulk density of the toner-particle-containing slurry before defoaming treatment is represented by C (kg/l), and the bulk density of the toner-particle-containing slurry after defoaming treatment by A (kg/l).

* * * * *